US008265902B1

(12) United States Patent
Brady et al.

(10) Patent No.: US 8,265,902 B1
(45) Date of Patent: Sep. 11, 2012

(54) CIRCUIT FOR MEASURING A TIME INTERVAL USING A HIGH-SPEED SERIAL RECEIVER

(75) Inventors: Noel J. Brady, Dublin (IE); Lionel Barker, Dublin (IE); Peter H. Alfke, Los Altos Hills, CA (US)

(73) Assignee: Xilinx, Inc., San Jose, CA (US)

( * ) Notice: Subject to any disclaimer, the term of this patent is extended or adjusted under 35 U.S.C. 154(b) by 368 days.

(21) Appl. No.: 12/544,437

(22) Filed: Aug. 20, 2009

(51) Int. Cl.
*G04F 1/00* (2006.01)

(52) U.S. Cl. ..... 702/176; 702/57; 702/79; 702/187; 702/178; 702/193

(58) Field of Classification Search ..... 702/176
See application file for complete search history.

(56) References Cited

U.S. PATENT DOCUMENTS 4,303,983 A * 12/1981 Chaborski ..... 702/176
4,523,289 A * 6/1985 Soma et al. ..... 702/176
4,613,951 A * 9/1986 Chu ..... 702/176
5,388,225 A * 2/1995 Cantrell et al. ..... 710/306
6,158,014 A * 12/2000 Henson ..... 713/501
6,331,999 B1 * 12/2001 Ducaroir et al. ..... 375/226
2007/0116465 A1 * 5/2007 Bieker ..... 398/70

* cited by examiner

*Primary Examiner* — Cindy H Khuu
*Assistant Examiner* — Timothy H Hwang
(74) *Attorney, Agent, or Firm* — LeRoy D. Maunu; Lois D. Cartier

(57) ABSTRACT

A circuit measures a time interval between a first event and a second event. One or more activity inputs receive a respective signal indicating the first and second events. For each activity input, a respective high-speed serial receiver includes a sampling circuit and a deserializer. The sampling circuit generates sample bits from sampling the respective signal at active edges of a clock signal. The deserializer converts the sample bits into a sequence of parallel data words. The sample bits undergo a first change in response to the first event and a second change in response to the second event. An arithmetic circuit receives the sequence of parallel data words from the respective high-speed serial receiver. The arithmetic circuit determines a number of the sample bits between the first and second changes in the sequence of parallel data words. The number measures the time interval between the first and second events.

17 Claims, 3 Drawing Sheets

CIRCUIT FOR MEASURING A TIME INTERVAL USING A HIGH-SPEED SERIAL RECEIVER

FIELD OF THE INVENTION

The present invention generally relates to time measurement, and more particularly to measuring a time interval between two events.

BACKGROUND

Measurement of time intervals accurately at nanosecond or picoseconds levels generally requires customized circuitry. However, it is time consuming and difficult to design customized circuitry.

Programmable logic devices (PLDs) are a well-known type of integrated circuit that can be programmed to perform specified logic functions to eliminate the need for customized circuitry. One type of PLD, the field programmable gate array (FPGA), typically includes an array of programmable tiles. These programmable tiles can include, for example, input/output blocks (IOBs), configurable logic blocks (CLBs), dedicated random access memory blocks (BRAM), multipliers, digital signal processing blocks (DSPs), processors, clock managers, delay lock loops (DLLs), and so forth.

Each programmable tile typically includes both programmable interconnect and programmable logic. The programmable interconnect typically includes a large number of interconnect lines of varying lengths interconnected by programmable interconnect points (PIPs). The programmable logic implements the logic of a user design using programmable elements that can include, for example, function generators, registers, arithmetic logic, and so forth.

The programmable interconnect and programmable logic are typically programmed by loading a stream of configuration data into internal configuration memory cells that define how the programmable elements are configured. The configuration data can be read from memory (e.g., from an external PROM) or written into the FPGA by an external device. The collective states of the individual memory cells then determine the function of the FPGA.

The functionality of the device is controlled by data bits provided to the device for that purpose. The data bits can be stored in volatile memory (e.g., static memory cells, as in FPGAs and some CPLDs), in non-volatile memory (e.g., FLASH memory, as in some CPLDs), or in any other type of memory cell.

Other PLDs are programmed by applying a processing layer, such as a metal layer, that programmably interconnects the various elements on the device. These PLDs are known as mask programmable devices. PLDs can also be implemented in other ways, e.g., using fuse or antifuse technology. The terms "PLD" and "programmable logic device" include but are not limited to these exemplary devices, as well as encompassing devices that are only partially programmable.

To design quickly an application including accurate time measurement, it would be advantageous to implement the application using a PLD and little customized circuitry or no customized circuitry at all.

The present invention may address one or more of the above issues.

SUMMARY

Various embodiments of the invention provide a circuit for measuring a time interval between a first event and a second event. One or more activity inputs receive a respective signal indicating the first and second events. A respective high-speed serial receiver is coupled to each activity input. The respective high-speed serial receiver includes a sampling circuit and a deserializer. The sampling circuit generates sample bits from sampling the respective signal at active edges of a clock signal. The deserializer converts the sample bits into a sequence of parallel data words. The sample bits undergo a first change in response to the first event and subsequent ones of the sample bits undergo a second change in response to the second event. An arithmetic circuit is coupled to receive the sequence of parallel data words from the respective high-speed serial receiver. The arithmetic circuit determines a number of the sample bits between the first and second changes in the sequence of parallel data words. The number measures the time interval between the first and second events.

In another embodiment, a circuit for measuring a time interval between a first event and a second event comprises means for receiving a respective signal, wherein the respective signal indicates the first and second events; means for generating a plurality of sample bits from sampling the respective signal at active edges of a clock signal; means for converting the sample bits into a sequence of parallel data words, wherein the sample bits undergo a first change in response to the first event and subsequent ones of the sample bits undergo a second change in response to the second event; and means for determining a number of the sample bits between the first and second changes in the sequence of parallel data words, the number measuring the time interval between the first and second events.

It will be appreciated that various other embodiments are set forth in the Detailed Description and Claims which follow.

BRIEF DESCRIPTION OF THE DRAWINGS

Various aspects and advantages of the invention will become apparent upon review of the following detailed description and upon reference to the drawings, in which.

DETAILED DESCRIPTION OF THE DRAWINGS

Various embodiments of the invention permit quick design of an application that accurately measures time intervals using little or no customized circuitry.

Figure 1:
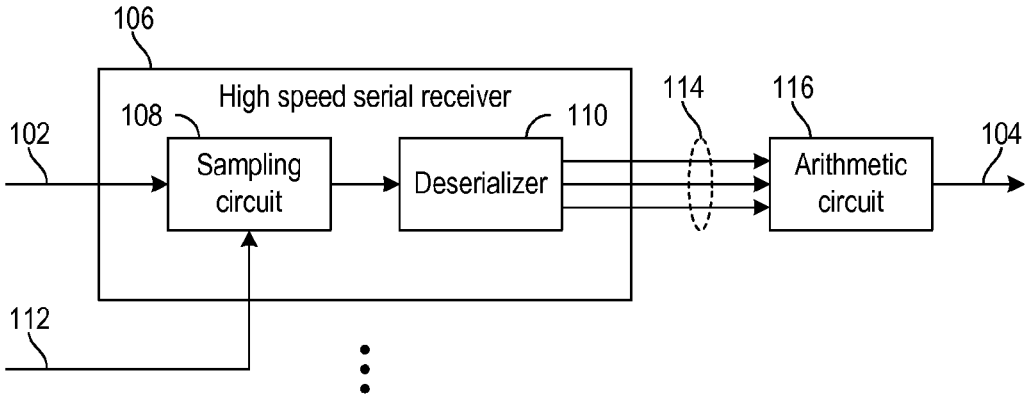
FIG. 1 is a block diagram of a circuit for measuring a time interval between two events in accordance with various embodiments of the invention.

FIG. 1 is a block diagram of a circuit for measuring a time interval between two events in accordance with various embodiments of the invention. The circuit samples an activity input on line 102 for receiving the two events and the circuit outputs a sample count on line 104 that measures the time interval between the two events.

A high-speed serial receiver 106 receives the two events encoded on the activity input on line 102. The high-speed serial receiver 106 includes a sampling circuit 108 and a deserializer 110.

The sampling circuit 108 samples the activity input on line 102 at active edges of a clock signal on line 112. In various embodiments of the invention, the active edges of the clock signal on line 112 are rising edges and/or falling edges, and the active edges of the clock signal on line 112 are synchronous or asynchronous with the two events defining the measured time interval. In an embodiment having the two events asynchronous with active edges of the clock signal on line 112, the sampling circuit 108 resolves any meta-stability resulting from sampling the active input on line 102 during one of the events. Thus, the sampling circuit 108 outputs a stream of binary values to the deserializer 110.

In one embodiment, a first event causes the stream of binary values from sampling circuit 108 to change from a zero-value to a one-value and a second event causes the stream of binary values to change from a one-value to a zero-value, and the time interval between these two events corresponds to the number of one-values in the stream. In another embodiment, the first and second events cause bit changes in the opposite direction.

The deserializer 110 generates a sequence of parallel data words on lines 114 from the stream of binary values from sampling circuit 108. The parallel data words on lines 114 each include a fixed number of bits, such as eight, ten, sixteen, or twenty bits. The deserializer 110 decreases the data transfer rate, allowing arithmetic circuit 116 to operate at a lower frequency than sampling circuit 108.

Arithmetic circuit 116 uses the parallel data words on lines 114 to count the number of bits in the stream between the changes caused by the two events. In one embodiment, for each parallel data word on lines 114, the arithmetic circuit 116 adds to an accumulator (not shown) the number of sample bits having the particular value corresponding to the interval between the two events. For the one or two parallel data words containing the changes caused by the two events, the value added to the accumulator is the number of sample bits having the particular value in these parallel data words. For any intermediate parallel data words between two parallel data words containing the changes caused by the two events, the value added to the accumulator is the fixed number bits in each parallel data word. The count on line 104 is a final value of the accumulator. This final value is a sum of the sample bits with the particular value in the parallel data words containing the changes for the two events plus a product of the fixed number and a variable number of the intermediate parallel data words. In some embodiments, line 104 is a multi-bit bus.

Figure 2:
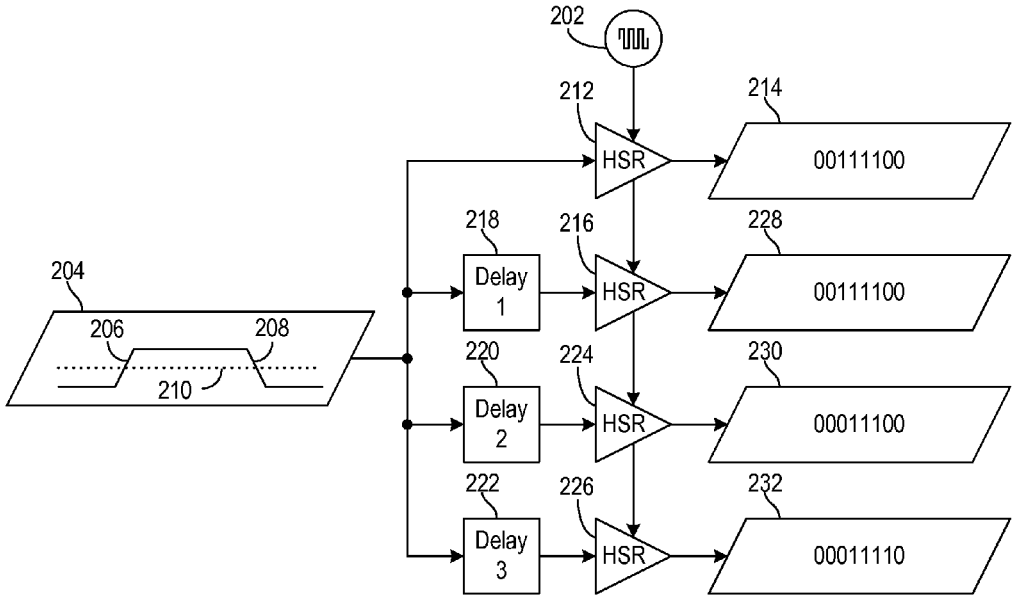
FIG. 2 is a dataflow diagram of a circuit for measuring a time interval between transitions of a signal using high-speed serial receivers and delay elements in accordance with various embodiments of the invention.

FIG. 2 is a dataflow diagram of a circuit for measuring a time interval between transitions of a signal using high-speed serial receivers and delay elements in accordance with various embodiments of the invention. This circuit permits measuring the time interval with a resolution greater than the time interval between the active edges of the clock signal from clock generator 202.

An input signal 204 defines a time interval between a rising edge 206 and a falling edge 208. The event of the rising edge 206 occurs when the rising edge 206 crosses a threshold 210, and the event of the falling edge 208 occurs when the falling edge 206 crosses the threshold 210.

High-speed serial receiver (HSR) 212 directly receives the input signal 204 at an activity input, and high-speed serial receiver 212 outputs a sequence 214 of 8-bit parallel data words. An output bit of the parallel data words in sequence 214 is a zero-value when the input signal 204 is below the threshold 210 and a one-value when the input signal 204 is above the threshold 210. In the illustrated example, the time interval between the rising and falling edges 206 and 208 is about the time interval for four active edges of the clock signal from clock generater 202, such that the sequence 214 includes four bits of a one-value, and these four bits happen to be grouped together into the single 8-bit parallel data word shown in sequence 214.

High-speed serial receiver 216 receives input signal 204 indirectly via delay element 218. Delay element 218 imparts a time delay to input signal 204 that is nominally one-fourth of the sampling interval between the active edges of the clock signal from clock generator 202. Thus, high-speed serial receiver 216 effectively samples the input signal 204 at sampling points offset relative to the sampling points of high-speed serial receiver 212. Delay elements 220 and 222 respectively impart a time delay to input signal 204 of nominally two-fourths and three-fourths of the sampling interval. Thus, high-speed serial receivers 212, 216, 224, and 226 effectively sample the input signal 204 at successively greater sampling offsets. Collectively, high-speed serial receivers 212, 216, 224, and 226 sample the input signal 204 at four times the rate of the active edges of the clock signal from clock generator 202.

Because of the offset sampling, high-speed serial receivers 212, 216, 224, and 226 generate slightly different sequences 214, 228, 230, and 232 of parallel data words. In one embodiment, an average of the counts of the one-bits in sequences 214, 228, 230, and 232 yields a measurement of 3.75 sampling intervals for the time interval between edges 206 and 208 of the input signal 204.

In one embodiment, a radio-frequency receiver demodulates received broadcast signals to generate the input signal 204, and traces on a printed circuit board route the inputs signals 204 from the radio-frequency receiver to the four high-speed serial receivers 212, 216, 224, and 226. The printed circuit board forms the traces with different lengths to implement the delay elements 218, 220, and 222 within the printed circuit board.

Figure 3:
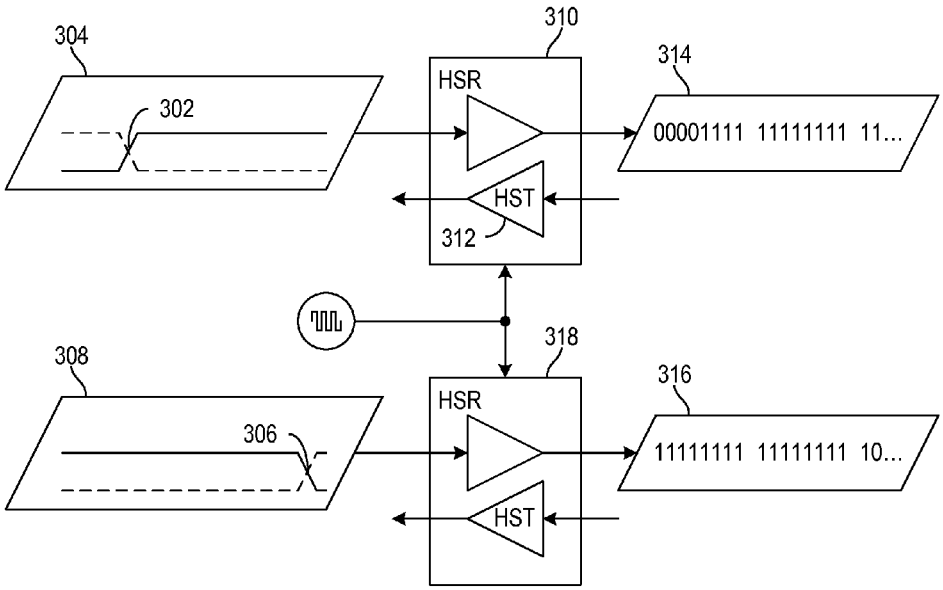
FIG. 3 is a dataflow diagram of a circuit for measuring a time interval between a differential transition on one signal and a differential transition on another signal in accordance with various embodiments of the invention.

FIG. 3 is a dataflow diagram of a circuit for measuring a time interval between a differential transition 302 on one signal 304 and a differential transition 306 on another signal 308 in accordance with various embodiments of the invention. Instead of two transitions of a single signal defining the start and end of the time interval as shown in FIG. 2, in FIG. 3 a transition of one signal defines the start of the time interval and a transition of another signal defines the end of the time interval.

A high-speed serial receiver 310 is a high-speed serial transceiver also including a high-speed serial transmitter (HST) 312. The high-speed serial receiver 310 receives the differential signal 304 and generates a sequence 314 of parallel data words. The parallel data words of sequence 314 include bits with zero-values for samples taken of differential signal 304 before the positive differential transition 302, and bits with one-values for samples taken of the differential signal 304 after the positive differential transition 302. Similarly, the parallel data words of sequence 316 include bits with one-values for samples high-speed serial receiver 318 takes of differential signal 308 before the negative differential transition 306, and zero-values for samples taken of differential signal 308 after the negative differential transition 306.

Thus, the change from a zero-value to a one-value within the parallel data words of sequence 314 indicates the start of the time interval, and the change from a one-value to a zero-value within the parallel data words of sequence 316 indicates the end of the time interval. Within the time interval, the bits of the parallel data words of sequences 314 and 316 both have a one-value. In one embodiment, corresponding parallel data words of sequence 314 and 316 are combined and the time interval is measured by counting bit pairs with one-values in the combined parallel data words. Note that bit pairs before the time interval have a value that differs from bit pairs after the time interval. It will be appreciated that either positive or negative direction crossings of the differential transitions can define the start and end of the time interval.

Figure 4:
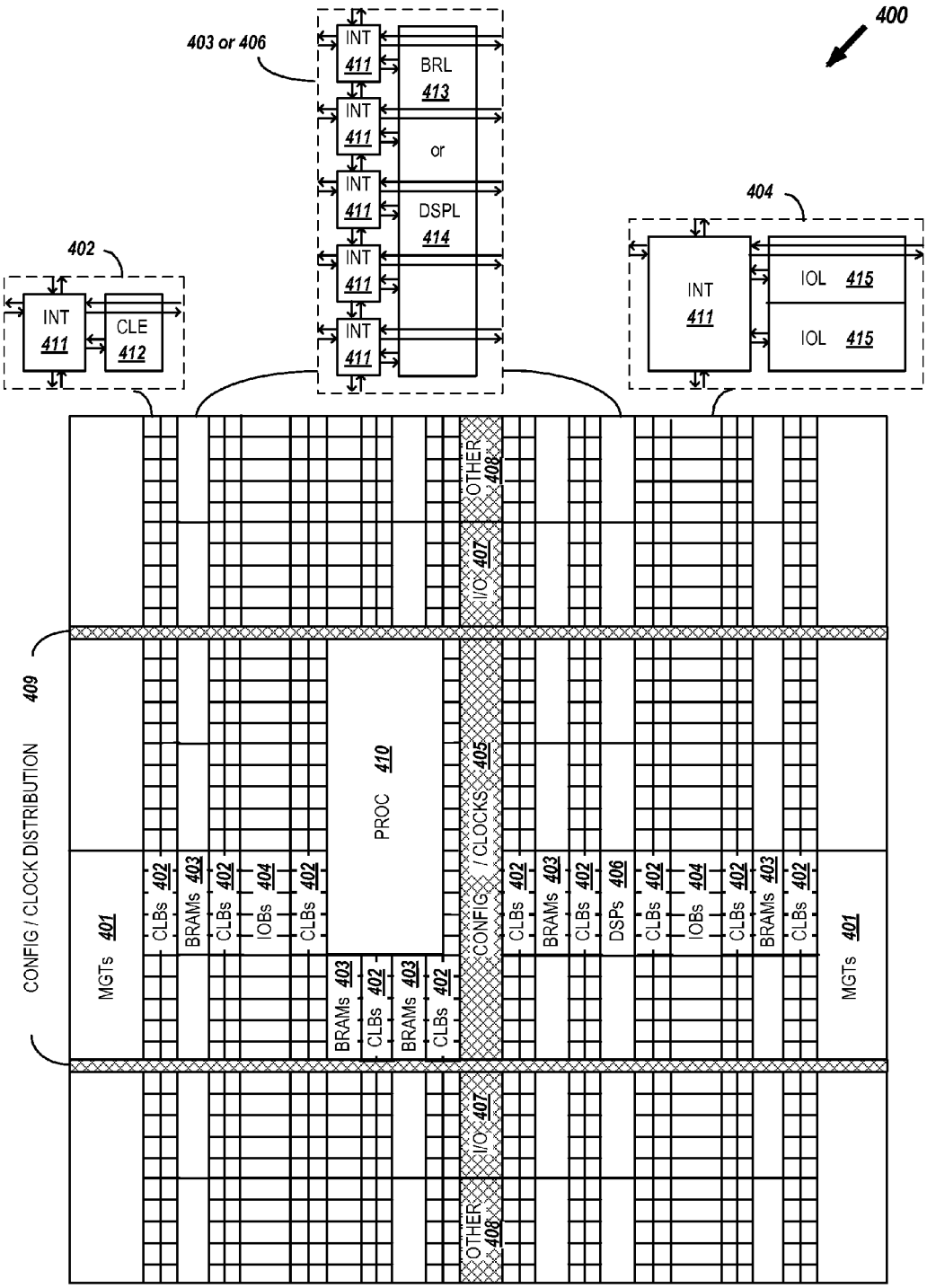
FIG. 4 is a block diagram of a programmable logic device including high-speed serial transceivers for measuring time intervals in accordance with various embodiments of the invention.

FIG. 4 is a block diagram of a programmable logic device including high-speed serial transceivers 401 for measuring time intervals in accordance with various embodiments of the invention.

Advanced FPGAs can include several different types of programmable logic blocks in the array. For example, FIG. 4 illustrates an FPGA architecture 400 that includes a large number of different programmable tiles including multi-gigabit transceivers (MGTs 401), configurable logic blocks (CLBs 402), random access memory blocks (BRAMs 403), input/output blocks (IOBs 404), configuration and clocking logic (CONFIG/CLOCKS 405), digital signal processing blocks (DSPs 406), specialized input/output blocks (I/O 407) (e.g., configuration ports and clock ports), and other programmable logic 408 such as digital clock managers, analog-to-digital converters, system monitoring logic, and so forth. Some FPGAs also include dedicated processor blocks (PROC 410).

In some FPGAs, each programmable tile includes a programmable interconnect element (INT 411) having standardized connections to and from a corresponding interconnect element in each adjacent tile. Therefore, the programmable interconnect elements taken together implement the programmable interconnect structure for the illustrated FPGA. The programmable interconnect element (INT 411) also includes the connections to and from the programmable logic element within the same tile, as shown by the examples included at the top of FIG. 4.

For example, a CLB 402 can include a configurable logic element (CLE 412) that can be programmed to implement user logic plus a single programmable interconnect element (INT 411). A BRAM 403 can include a BRAM logic element (BRL 413) in addition to one or more programmable interconnect elements. Typically, the number of interconnect elements included in a tile depends on the height of the tile. In the pictured embodiment, a BRAM tile has the same height as four CLBs, but other numbers (e.g., five) can also be used. A DSP tile 406 can include a DSP logic element (DSPL 414) in addition to an appropriate number of programmable interconnect elements. An 10B 404 can include, for example, two instances of an input/output logic element (IOL 415) in addition to one instance of the programmable interconnect element (INT 411). As will be clear to those of skill in the art, the actual I/O pads connected, for example, to the I/O logic element 415 are manufactured using metal layered above the various illustrated logic blocks, and typically are not confined to the area of the input/output logic element 415.

In the pictured embodiment, a columnar area near the center of the die (shown shaded in FIG. 4) is used for configuration, clock, and other control logic. Horizontal areas 409 extending from this column are used to distribute the clocks and configuration signals across the breadth of the FPGA.

Some FPGAs utilizing the architecture illustrated in FIG. 4 include additional logic blocks that disrupt the regular columnar structure making up a large part of the FPGA. The additional logic blocks can be programmable blocks and/or dedicated logic. For example, the processor block PROC 410 shown in FIG. 4 spans several columns of CLBs and BRAMs.

Note that FIG. 4 is intended to illustrate only an exemplary FPGA architecture. The numbers of logic blocks in a column, the relative widths of the columns, the number and order of columns, the types of logic blocks included in the columns, the relative sizes of the logic blocks, and the interconnect/logic implementations included at the top of FIG. 4 are purely exemplary. For example, in an actual FPGA more than one adjacent column of CLBs is typically included wherever the CLBs appear, to facilitate the efficient implementation of user logic.

Those having skill in the relevant arts of the invention will now perceive various modifications and additions that can be made as a result of the disclosure herein. For example, the above text describes the circuits and methods of the invention in the context of programmable ICs such as programmable logic devices (PLDs), e.g., field programmable gate arrays (FPGAs). However, the circuits of the invention can also be implemented in other integrated circuits and other electronic systems, including circuits and systems that are non-programmable or are only partially programmable.

Accordingly, all such modifications and variations are deemed to be within the scope of the invention, which is to be limited only by the appended claims and their equivalents.

What is claimed is:

1. A circuit for measuring a time interval between a first event and a second event, comprising:

at least one activity input for receiving a respective signal, wherein the respective signal has a first transition that indicates the first event, a second transition that indicates the second event, and no transitions between the first and second transitions;

a respective high-speed serial receiver coupled to each activity input, the respective high-speed serial receiver including a sampling circuit and a deserializer, the sampling circuit configured to generate a plurality of sample bits from sampling the respective signal at active edges of a clock signal occurring between the first and second transitions of the respective signal, and the deserializer configured to convert the sample bits into a sequence of parallel data words, wherein the sample bits undergo a first change in response to the first transition and subsequent ones of the sample bits undergo a second change in response to the second transition; and an arithmetic circuit coupled to receive the sequence of parallel data words from the respective high-speed serial receiver, wherein the arithmetic circuit is configured to determine a number of the sample bits between the first and second changes in the sequence of parallel data words, and the number measures the time interval between the first and second events.

2. The circuit of claim 1, wherein the sample bits for the activity input undergo the first change from a first value to a second value in response to the first event and the second change from the second value to the first value in response to the second event.

3. The circuit of claim 1, wherein, for the sampling circuit of the respective high-speed serial receiver coupled to the activity input, the sampling circuit generates the first change of the sample bits in response to the first transition of the respective signal of the activity input and the sampling circuit generates the second change of the sample bits in response to the second transition of the respective signal of the activity input.

4. The circuit of claim 3, wherein the sampling circuit generates the first change of the sample bits in response to the first transition crossing a threshold in one direction and the sampling circuit generates the second change of the sample bits in response to the second transition crossing the threshold in another direction.

5. The circuit of claim 3, wherein the respective signal of the activity input is a differential pair, and the sampling circuit generates the first change of the sample bits in response to the differential pair crossing in one direction at the first transition and the sampling circuit generates the second change of the sample bits in response to the differential pair crossing in another direction at the second transition.

6. The circuit of claim 1, wherein, for the sampling circuit of the respective high-speed serial receiver coupled to each activity input, the sampling circuit samples the activity input at the active edges of the clock signal, and the active edges of the clock signal are one of a plurality of rising edges of the clock signal, a plurality of falling edges of the clock signal, and a plurality of rising and falling edges of the clock signal.

7. The circuit of claim 1, wherein the sampling circuit of the respective high-speed serial receiver coupled to the at least one activity input resolves sampling meta-stability arising from the active edges of the clock signal being asynchronous to the first and second events.

8. The circuit of claim 1, wherein the respective high-speed serial receiver coupled to each activity input is a high-speed serial transceiver, the sampling circuit and the deserializer of the respective high-speed serial receiver included in a high-speed serial receiver, and the high-speed serial transceiver including the high-speed serial receiver and a high-speed serial transmitter.

9. The circuit of claim 1, wherein the arithmetic circuit determines respective numbers of the sample bits having a particular value in a first and second one of the parallel data words and determines a variable number of intermediate ones of the parallel data words in the sequence between the first and second parallel data words, each of the parallel data words in the sequence including a fixed number of the sample bits, the number of the sample bits between the first and second changes in the sequence of parallel data words being a sum of the respective numbers of sample bits having the particular value in the first and second parallel data words and a product of the fixed number and the variable number of the intermediate parallel data words.

10. The circuit of claim 1, further comprising respective delay elements coupled to a plurality of activity inputs included in the at least one activity input, the respective delay elements delaying the respective signal for the activity inputs by a corresponding plurality of delays approximately evenly distributed over a range matching a time period between the active edges of the clock signal.

11. A circuit for measuring a time interval between a first event and a second event, comprising:

means for receiving a respective signal, wherein the respective signal indicates the first and second events;

wherein the received respective signal has a first transition indicating the first event, a second transition indicating the second event, and no transitions between the first and second transitions;

means for generating a plurality of sample bits from sampling the respective signal at active edges of a clock signal occurring between the first and second transitions of the respective signal;

means for converting the sample bits into a sequence of parallel data words, wherein the sample bits undergo a first change in response to the first transition and subsequent ones of the sample bits undergo a second change in response to the second transition; and means for determining a number of the sample bits between the first and second changes in the sequence of parallel data words, the number measuring the time interval between the first and second events.

12. The circuit of claim 11, wherein the sample bits for the activity input undergo the first change from a first value to a second value in response to the first event and the second change from the second value to the first value in response to the second event.

13. The circuit of claim 11, wherein the means for generating generates the first change of the sample bits in response to the first transition of the respective signal and generates the second change of the sample bits in response to the second transition of the respective signal.

14. The circuit of claim 13, wherein the means for generating generates the first change of the sample bits in response to the first transition crossing a threshold in one direction and generates the second change of the sample bits in response to the second transition crossing the threshold in another direction.

15. The circuit of claim 11, wherein the active edges of the clock signal are one of a plurality of rising edges of the clock signal, a plurality of falling edges of the clock signal, and a plurality of rising and falling edges of the clock signal.

16. The circuit of claim 11, further comprising means for resolving sampling meta-stability arising from the active edges of the clock signal being asynchronous to the first and second events.

17. A circuit for measuring a time interval between a first event and a second event, comprising:

a first and second activity input, wherein the first activity input is configured to receive a respective signal having a first transition indicating the first event, the second activity input is configured to receive a respective signal having a second transition indicating the second event, and there are no transitions between the first and second transitions;

a respective high-speed serial receiver coupled to each activity input, the respective high-speed serial receiver including a sampling circuit and a deserializer, the sampling circuit configured to generate a plurality of sample bits from sampling the respective signal at active edges of a clock signal occurring between the first and second transitions of the respective signals, and the deserializer configured to convert the sample bits into a sequence of parallel data words, wherein the sample bits undergo a first change in response to the first transition and subsequent ones of the sample bits undergo a second change in response to the second transition; and an arithmetic circuit coupled to receive the sequence of parallel data words from the respective high-speed serial receiver, wherein the arithmetic circuit determines a number of the sample bits between the first and second changes in the sequence of parallel data words, and the number measures the time interval between the first and second events.

* * * * *